United States Patent [19]

Wedig et al.

[11] 4,165,843

[45] Aug. 28, 1979

[54] APPARATUS FOR WINDING A WEB OF MATERIAL, ESPECIALLY PAPER

[75] Inventors: Walter Wedig, Stutensee-Blankenloch; Ernst-Otto Krämer, Hilden, both of Fed. Rep. of Germany

[73] Assignee: Jagenberg Werke Aktiengesellschaft, Duesseldorf, Fed. Rep. of Germany

[21] Appl. No.: 929,610

[22] Filed: Jul. 31, 1978

[30] Foreign Application Priority Data

Sep. 2, 1977 [DE] Fed. Rep. of Germany ..... 2739515

[51] Int. Cl.[2] ..... B63K 17/08

[52] U.S. Cl. ..... 242/66

[58] Field of Search ..... 242/66, 67.1 R, 56 R, 242/156

[56] References Cited

U.S. PATENT DOCUMENTS

| | | | |
|---|---|---|---|
| 2,012,118 | 8/1935 | Cameron | 242/66 |
| 3,104,845 | 9/1963 | Patterson | 242/66 |
| 3,837,593 | 9/1974 | Dorfel | 242/66 |
| 3,858,820 | 1/1975 | Crouse | 242/66 |
| 4,047,676 | 9/1977 | Dahl | 242/66 |

*Primary Examiner*—Edward J. McCarthy

*Attorney, Agent, or Firm*—Sprung, Felfe, Horn, Lynch & Kramer

[57] ABSTRACT

An apparatus for winding a web of material has first and second supporting rolls each driven by a motor and has a gap therebetween wherein the spool of the web of goods being rolled is pressure biased by a pressure roll disposed thereabove. A control mechanism for the motors controls same so that as the coil diameter increases, the torque of the motor associated with the first supporting roll increases in the direction of movement of the web and the torque of the motor associated with the second supporting roll decreases in the direction of the movement of the web. The drives of the two supporting rolls are coupled by a brake of speed proportional braking torque for damping accelerations of the supporting rolls due to the displacement of the web from at least one thereof.

4 Claims, 4 Drawing Figures

APPARATUS FOR WINDING A WEB OF MATERIAL, ESPECIALLY PAPER

BACKGROUND

The invention relates to an apparatus for the winding of a web of material, such as paper, comprising two supporting rolls each driven by a motor and having a gap therebetween wherein the spool on which the web of goods is to be wound is pressure biased by a pressure roll, and control means for the motors which preferably, as the coil diameter increases, increases the torque of the motor of the first supporting roll in the direction of the movement of the web and diminishes the torque of the motor of the second supporting roll in the direction of movement of the web.

In a known apparatus for the winding of a web of goods, the two supporting rolls are coupled together by a gear drive and are driven by a single motor. To enable the web of goods to be wound with the desired tightness, the supporting rolls are rotated at a slight difference in their circumferential speed. It has been found that in such an apparatus the spool runs roughly on the supporting rolls and consequently the quality of the winding of the web of goods is unsatisfactory.

In another apparatus for the winding of webs of goods, in which the two rolls are also driven by only one motor, the supporting rolls are coupled together by a belt drive. This type of coupling results in a smoother running and in a better coil quality.

Disadvantageous to the coil quality in both of the known apparatus is the stiff coupling of the two supporting rolls. Attempts have been made to eliminate this disadvantage with another known apparatus.

In this apparatus, each supporting roll is associated with a motor of its own. The torque of the two motors is controlled in relation to the coil diameter such that the motor associated with the first supporting roll in the direction of movement of the web is operated with an increasing torque and the motor associated with the second supporting roll in the direction of movement of the web is operated with a decreasing torque. With such an apparatus it is in principle possible to wind the web of goods with a tightness which diminishes from the core out. But in this apparatus, the results of the winding are unsatisfactory, because during the winding, the coil oscillates on the supporting rolls.

THE INVENTION

It is the object of the invention to create an apparatus for the winding of a web of goods, in which virtually no oscillations occur during the winding.

This object is achieved in accordance with the invention by the fact that the drives of the two supporting rolls are coupled together by means of a brake with a speed-proportional braking moment. The brake can be an electrical or hydraulic brake, especially an eddy current brake. Preferably, dampers are associated with the pressure roll which preferably comprises a plurality of partial lengths and is supported by a crossbeam.

In the apparatus of the invention, no amplification of vibrations occurs, since the brake acting proportionally to the speed between the two supporting rolls prevents a supporting roll from slipping when the coil is lifted away from the roll. The disadvantageous vibrations are therefore suppressed by very simple means. The brake has no influence on the torque of the two supporting rolls. By the combination of the brake and of the pressure roll whose vertical movements are damped, not only rotational but also vertical vibrations are suppressed.

BRIEF DESCRIPTION OF THE DRAWINGS

The invention will be further explained below with the aid of the drawings which are diagrammatic representations of an example of its embodiment.

DETAILED DESCRIPTION OF THE INVENTION

Figure 1:
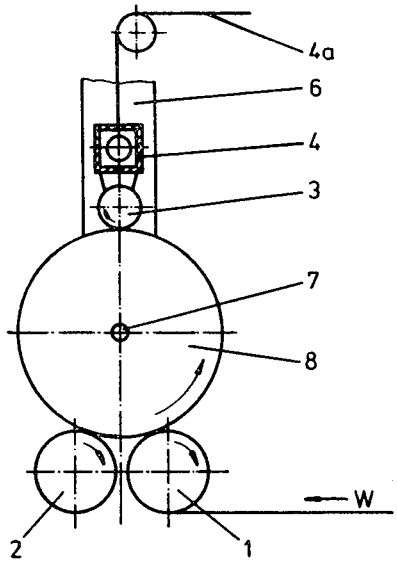
FIG. 1 is a side elevational view of an apparatus for winding a web of goods.
Figure 2:
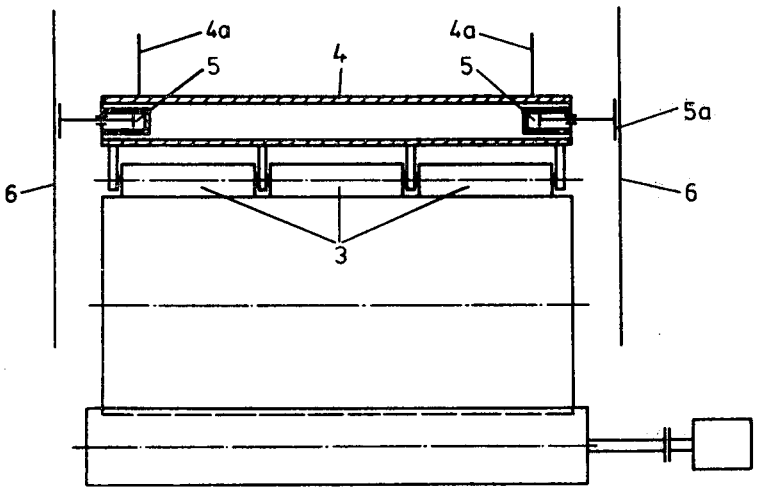
FIG. 2 is a front elevational view of the apparatus of FIG. 1.

Referring to FIGS. 1 and 2, the apparatus of the invention consists of two supporting rolls 1 and 2 which rotate in the direction indicated by the arrows, and of a pressure roll 3 disposed in the center at a distance above the supporting rolls. The pressure roll 3 is divided into three parts, each part of the pressure roll being fastened to a crossbeam 4. The crossbeam 4 is suspended from chains 4*a* bearing at their free ends a counterweight which is not shown. In the two opposite, open ends of the crossbeam 4 there are installed two dampers 5 operated by compressed air and constructed as cylinder-and-piston systems with friction surfaces 5*a* at the ends of their piston rods thrusting against a frame 6.

In the gap between the supporting rolls 1 and 2 and between them and the pressure roll 3, there is disposed a web of goods in a coil 8 wound on a spool 7. This is set in rotation by frictional engagement with the driven supporting rolls 1 and 2.

Figure 3:
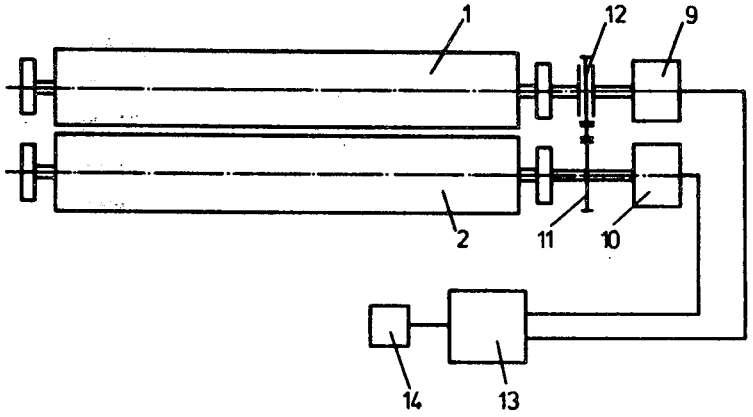
FIG. 3 is a plan view of the two supporting rolls of the apparatus of FIG. 1 showing the means for controlling the motors.

As shown in FIG. 3, with each supporting roll 1 and 2 there is associated its own drive motor 9 and 10. The two supporting rolls 1 and 2 are coupled together by a gear drive 11 and an eddy current brake 12. The motors 9 and 10 are controlled by a control system 13 in relation to the diameter of coil 8 which is detected by a sensor 14.

Figure 4:
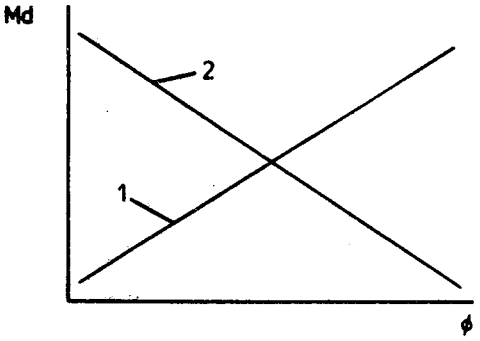
FIG. 4 is a diagram of the torques of the two supporting rolls in relation to the diameter of the wound web of goods.

The apparatus of the invention operates in the following manner:

The web of goods W is drawn by the supporting roll 1 and fed to the spool 7. The spool 7 rests on the supporting roll 1 and supporting roll 2. To obtain a solid core, the torque of the two motors 9 and 10 and hence also that of the supporting rolls 1 and 2 is adjusted to the tension of the web of material on spool 7 such that the core is wound tightly. The curve representing the torques is shown in FIG. 4 with respect to the diameter. The pressure roll 3 keeps the spool 7, with the web wound on it, in the gap between the supporting rolls 1 and 2 and damps vertical vibrations occurring during the winding. The diameter of the coil 8, which increases as winding progresses, is detected by means of the sensor 14 and a corresponding signal is delivered to the control means 13. The control means 13 varies the torques of the motors 9 and 10 in accordance with the torque curves shown in FIG. 4, so that the tightness with which the coil 8 is wound diminishes from the inside out. As long as the coil 8 lies on the supporting rolls 1 and 2 without slippage, the eddy current brake 12 will not operate. Only when, as a result of vibrations, the coil 8 lifts away from one or the other of the supporting roll 1 and 2 and the free supportting roll tends to accelerate due to the applied torque, does the eddy current brake go into operation and prevent or damp this acceleration. For this reason, amplification of the vibrations cannot occur.

It will be appreciated that the instant specification and claims are set forth by way of illustration and not limitation and that various changes and modifications may be made thereto without departing from the spirit and scope of the present invention.

What is claimed is:

1. In an apparatus for winding a web of material having first and second supporting rolls each driven by a motor and having a gap therebetween wherein the spool of the web of goods being rolled is pressure biased by a pressure roll disposed thereabove, and control means for the motors which, as the coil diameter increases, increases the torque of the motor associated with the first supporting roll in the direction of movement of the web and decreases the torque of the motor associated with the second supporting roll in the direction of movement of the web, the improvement comprising: means coupling the drives of the two supporting rolls comprising a brake of speed-proportional braking torque for damping acclerations of the supporting rolls due to the displacement of the web therefrom.

2. Apparatus according to claim 1, wherein the brake is one of an electrical of hydraulic brake.

3. Apparatus according to claim 2, wherein the brake is an eddy current brake.

4. Apparatus according to claim 1, wherein the pressure roll comprises at least two sections, a common crossbeam supporting the sections and dampers damping the vertical movements of the crossbeam.

* * * * *